United States Patent [19]

DeLano, Jr.

[11] 4,073,630

[45] Feb. 14, 1978

[54] PRODUCTION OF CARBON MONOXIDE

[75] Inventor: Merritt V. DeLano, Jr., Bartlesville, Okla.

[73] Assignee: Phillips Petroleum Company, Bartlesville, Okla.

[21] Appl. No.: 735,362

[22] Filed: Oct. 26, 1976

[51] Int. Cl.[2] ..... C10J 3/06

[52] U.S. Cl. ..... 48/197 R; 48/210; 48/211; 252/373; 423/415 A

[58] Field of Search ..... 48/197 R, 210, 211; 423/415 A, 107; 75/86, 88; 252/373

[56] References Cited

U.S. PATENT DOCUMENTS

| | | | |
|---|---|---|---|
| 542,590 | 7/1895 | Looney | 48/197 R |
| 1,484,225 | 2/1924 | Lundin | 48/210 |
| 1,705,128 | 3/1929 | Motzel | 75/86 |
| 1,877,122 | 9/1932 | Brinker | 423/107 |
| 1,899,184 | 2/1933 | Simo | 75/86 |
| 2,342,368 | 2/1944 | Queneau | 75/86 |
| 2,560,175 | 7/1951 | Kalbach | 75/86 |
| 2,607,670 | 8/1952 | Lewis | 423/415 |
| 2,631,933 | 3/1953 | Herbst | 48/196 R |
| 2,682,457 | 6/1954 | Gorin | 48/197 R |
| 2,879,148 | 3/1959 | Atwell | 48/206 |

*Primary Examiner*—S. Leon Bashore
*Assistant Examiner*—Peter F. Kratz

[57] ABSTRACT

In a system wherein carbon monoxide is produced from a carbon source by contacting the carbon source with solid zinc oxide in a primary reaction zone, zinc values which are entrained in the ash byproduct are recovered, reconverted to zinc oxide and reused for production of additional carbon monoxide in a secondary reaction zone wherefrom the zinc is recovered, reconverted to zinc oxide and thereafter reused in the primary reaction zone.

14 Claims, 1 Drawing Figure

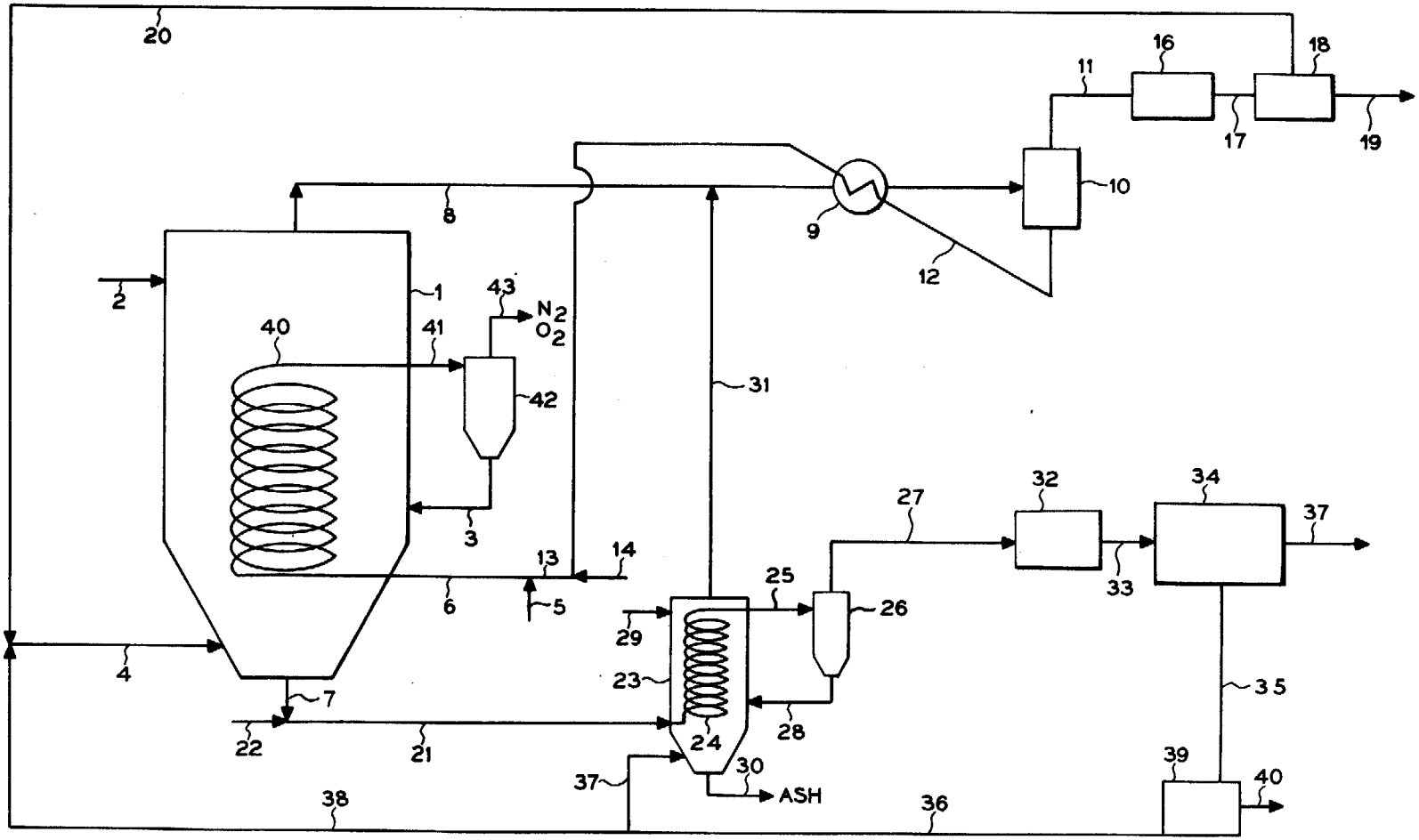
ASH
$N_2$
$O_2$

PRODUCTION OF CARBON MONOXIDE

This invention relates broadly to the gasification of carbon sources. In one of its more specific aspects, this invention relates to the production of carbon monoxide.

BACKGROUND OF THE INVENTION

The conversion of solid carbon sources to carbon monoxide has been under development for many years. Such processes are of great interest since they generally have the capability of providing an environmentally clean process for carbon utilization, of producing a high heating value gas which can substitute for natural gas, and of producing a low heating value gas suitable for use as synthesis gas for subsequent conversion to hydrocarbons or chemicals or as boiler fuel.

However, many of such processes introduce air into the reactor, which is generally undesirable since large volumes of nitrogen must be handled in the process. These nitrogen gases have no function in a coal gasification process and add to the process costs as well as to the equipment size. To avoid the use of air, a system has been proposed wherein zinc oxide is used as the oxygen source. While such a process has many advantages over the use of air, it has the problem of loss of zinc values in the ash byproduct. Such values are generally in the form of zinc sulfide.

THE INVENTION

It is, therefore, one object of this invention to provide a process for producing carbon monoxide.

Another object of the invention is to provide a process for the production of carbon monoxide by gasification of carbon sources such as coal, char, coke, bitumen, heavy oils and the like.

A further object of the invention is to provide a process for the production of carbon monoxide essentially without the use of air in the main carbon monoxide-forming reaction.

Yet another object of this invention is to provide a process for recovering zinc values from ash byproduct formed during the conversion of carbonaceous materials into carbon monoxide gas using zinc oxide as the oxygen source.

These and other objects, advantages, details, features and embodiments of the invention will become apparent to those skilled in the art from the following detailed description of the invention, the appended claims and the drawing, which shows a schematic flow diagram for carrying out the process of the invention.

In accordance with this invention, I have discovered that zinc values, which are otherwise lost in the ash byproduct when using zinc oxide as the oxygen source for the conversion of a carbonaceous source to carbon monoxide in a primary reaction zone, are readily recovered by treating the ash containing zinc values with hot air whereby the zinc values are converted to zinc oxide. The resulting zinc oxide in admixture with ash is thereafter used as the oxygen source for conversion of additional carbon source to carbon monoxide in a secondary reaction zone wherefrom a carbon monoxide and zinc metal mixture is removed. Zinc is separated from the carbon monoxide, reconverted to zinc oxide and thereafter returned to the primary reaction zone.

Thus, in accordance with the present invention, a process is provided for the conversion of a carbon source to a gas consisting essentially of carbon monoxide wherein zinc oxide is used as the oxygen source, which comprises (a) reacting a first quantity of a carbon source in a first reaction zone with zinc oxide at elevated temperature to produce a first volume of gas consisting essentially of zinc and carbon monoxide and a solids byproduct consisting essentially of ash having zinc values entrained therein, (b) separating zinc from the first volume of gas and recovering a carbon monoxide-containing gas as a product of the process, (c) passing the solids byproduct from the first reaction zone to an oxidation zone wherein the zinc values in the solids byproduct are oxidized to zinc oxide, thereby forming a solid mixture consisting essentially of ash and zinc oxide, (d) reacting the solid mixture in a second reaction zone at elevated temperature with a second quantity of a carbon source to produce a second volume of gas consisting essentially of zinc and carbon monoxide, and thereafter (e) separating zinc from the second volume of gas and recovering a carbon monoxide-containing gas as a product of the process.

The reaction in the secondary reaction zone, wherein the zinc values in the form of zinc oxide are utilized for the conversion of additional carbon source to carbon monoxide, it also carried out at elevated temperature. The reaction in both reaction zones is generally conducted at a temperature in the range of 910 ° C. to 1540 ° C. To assure high zinc oxide conversion, the second reaction is preferably operated at a higher temperature and for a longer reaction time than that employed in the first reaction zone. An average reaction time of from 5 minutes to about 2 hours is satisfactory. However, since the reaction between the carbonaceous source and the zinc oxide is endothermic, high temperatures in either reaction zone will generally result in shorter reaction times.

The zinc oxide in the first reaction zone is preferably employed in a finely divided particle form. These particles can have a size such as to pass entirely through a 45-mesh screen (ASTM Method D293-29). Smaller particles can be used. Larger particles tend to slow down the reaction. The zinc oxide of appropriate size is readily achieved through the oxidation of zinc vapor.

The zinc oxide in the second reaction zone is similarly preferred to be in a finely divided state, as employed in the first reaction zone. If necessary, the ash-zinc oxide mixture can be passed through a grinder before introduction into the second reaction zone.

The primary reactions involved in the process are generally solid/solid reactions so that the pressure is not critical. If it is desired to remove a carbon monoxide gas under pressure, the reactor is either pressurized or the reactor is a closed batch reactor with pressure-actuated valve in the carbon monoxide withdrawal line. Generally, however, the pressure will be slightly above atmospheric pressure, e.g., in the range of 0.1 to 50 psig (102–446 kPa).

The process of this invention can advantageously be used to gasify and convert to carbon monoxide even those solid carbon sources that are solid residues from other gasifications or liquefactions of other carbon sources such as char, coal, shale oil, oil and residual oil in the primary reactor. Examples for coal pyrolysis processes resulting in a solid char residue are the COED processes (developed by FMC Corp.), the Garrett process, the Synthane process and the Toscoal process. Under this aspect of the invention, char is the preferred solid source for the process of the invention.

A heavy carbon source or a heavy carbonaceous material such as coal, coke, char, residual oils, tar and asphalt, is preferably used for the purposes of this invention in the primary reactor. Among these carbon sources, solid carbon sources such as coal, coke and char are presently preferred. Solid carbon sources are those that are solid under temperatures of up to 2500 ° F. (1373 ° C.). The solid carbon source materials are preferably employed in finely divided form. Advantageously, the solid carbon source consists of particles having a diameter of less than about 0.4 mm. The particle size refers to the longest extension of the individual particle.

Since it is desired to avoid loss of zinc in the secondary reactor by further entrainment of zinc values in the ash, carbon sources for the secondary reactor are preferably those having a very low sulfur content, below 0.01 weight percent, or those which are essentially free of sulfur. Operation of the second reactor with such feedstock results in the ability to convert the regenerated zinc oxide to zinc metal which can then be removed in a vaporized form with the carbon monoxide.

Suitable carbon sources for feed to the secondary reactor are any sulfur-free or essentially sulfur-free carbon compounds, such as sulfur-free oil or low sulfur content coal char, residual oils or coke from sweet crudes (e.g., Gulf Coast), coke from low-sulfur coals (e.g., Wyoming or Eastern coals which contain less than 0.5 weight percent sulfur).

In both the zinc oxidation zone, wherein zinc values in the ash are converted to zinc oxide, as well as in the zinc oxidizer, wherein vaporized zinc is converted to particulate zinc oxide, the zinc is combusted with an oxygen source in an exothermic reaction. Examples of suitable oxygen sources are air, steam, oxygen-enriched air and oxygen. Air is the presently preferred oxygen source. Generally the oxygen source is used in quantities above the stoichiometric requirement. Preferably about 1.05 to about 1.25 atoms of available oxygen per atom of zinc are utilized. The reaction is generally carried out at a temperature in the range of 200 ° F. (1093 ° C.) to 3000 ° F. (1650 ° C.).

The relative quantities of solid oxygen donor and carbon source can be varied in fairly broad ranges in both reaction zones. Generally the zinc oxide oxygen donor is used in such a quantity that a slight surplus of available oxygen atoms per available carbon atoms is achieved in the primary or first reaction zone. A range of 0.8 to 1.2 moles of zinc oxide, preferably about 1 mole of zinc oxide per gram atom of carbon source, can be employed in each reaction zone. However, since recovery of zinc values from the ash is of overriding importance in the second reaction zone, a slight deficiency of available oxygen is generally preferred.

The process of this invention preferably, and in accordance with the preferred embodiment of this invention, is carried out as follows. The carbon source and the zince oxide are both admixed in finely divided form in a primary reactor to form a reaction mixture. The reaction mixture is heated to a temperature in the range of 910 ° c. to 1450 ° C. The reaction mixture is continually stirred either mechanically or by means of a fluidizing gas, such as carbon dioxide. This carbon dioxide is largely converted to carbon monoxide by the reaction: $CO_2 + C \rightarrow 2CO$, and thus contributes to the overall productivity of the process to yield CO. From the reactor is withdrawn a gas comprising carbon monoxide and zinc vapor. The relative quantities of CO and $CO_2$ in the gas depend upon the reaction conditions employed. From the bottom of the reactor are withdrawn solids containing ash. The gas mentioned above is separated into a gas stream consisting essentially of carbon monoxide and a liquid zinc stream, preferably by cooling the stream sufficiently to condense the zinc, and the $CO_2$ is separated by conventional means, e.g., absorption in alkaline solutions such as amines (monoethanolamine) or potassium carbonate. The zinc stream is then contacted in an oxidation zone with oxygen to form zinc oxide, and the zinc oxide formed is reintroduced into the reaction zone. The reaction mixture is heated during the entire process in the primary reactor by indirect heat exchange with the oxidation reaction mixtures.

Zinc values entrained in ash from the first reaction zone are contacted at a temperature in the range of 1093 ° to 1650 ° C. in a second oxidation zone with oxygen to form a second quantity of zinc oxide. This recovered or regenerated zinc oxide in admixture with ash is introduced to a secondary reaction zone wherein a quantity of low-sulfur or sulfur-free carbon source is converted to carbon monoxide at a temperature in the range of 910 ° to 1540 ° C. Heating of the reaction mixture is achieved by indirect heat exchange with the oxidation reaction mixture wherein the entrained zinc values are converted to zinc oxide. From the reactor a gas comprising essentially carbon monoxide and zinc vapor is withdrawn. From the bottom of the reactor solids containing ash which is essentially free of zinc values are withdrawn. The carbon monoxide-zinc gas may be combined with product gas from the first reactor which is then cooled and separated into a gas stream consisting of carbon monoxide and a liquid zinc stream. The zinc stream, representing the recovered zinc values, is then reoxidized to zinc oxide for return to the primary reactor.

By using a low-sulfur or essentially sulfur-free carbon source in the secondary reaction zone, essentially all of the zinc oxide is converted to zinc metal.

The term "zinc values" as used herein is intended to mean zinc in any form which is removed with ash from the primary reactor. Such form can, then, be unreacted zinc oxide, zinc sulfide formed due to the presence of sulfur in the system, and possibly zinc silicates or other zinc complexes formed during the initial carbon monoxide production.

The gaseous effluent after the removal of zinc therefrom consists essentially of carbon monoxide and minor amounts of carbon dioxide, hydrogen and light hydrocarbons admixed therewith. This gas eventually, after admixture with further hydrogen, can be utilized for many processes, e.g., the Fischer-Tropsch process for producing liquid hydrocarbons. It can also be burned as a clean medium-Btu boiler fuel.

The carbon source for the first reaction zone, such as coke and char, can contain a considerable amount of sulfur, e.g., up to 8 weight percent. The carbon monoxide gas produced in the first reaction zone is essentially sulfur-free since the sulfur contained in the carbon source is converted to sulfides of zinc, which are entrained and withdrawn from the reactor with the ash, and the zinc thus introduced into the ash is recovered therefrom in such a manner as to preclude introduction of sulfur to the second reactor. Preferably the carbon source for the second reactor is essentially sulfur-free to avoid sulfide formation therein. This in turn permits the recovery of essentially all previously entrained zinc values as zinc vapor from the reactor.

With the general nature and objects of the invention having been set forth, the latter will best be understood from the more detailed description hereafter, in which reference will be made to the accompanying schematic flow diagram of the process of the invention. The invention will be described in connection with a presently preferred embodiment thereof, wherein hot char from a coal gasification or liquefaction operation is utilized as feedstock for the production of carbon monoxide.

Referring now in detail to the diagram, hot char at a temperature of about 2000 ° F. is introduced into the primary reactor 1 via line 2. Solid particulate zinc oxide is introduced into the primary reactor via line 3. The solid materials are mixed in the reactor 1 by a fluidizing stream of carbon dioxide, carbon monoxide or a mixture of carbon monoxide and carbon dioxide which is introduced into the reactor via line 4. The initial charge of zinc oxide as oxygen source to reactor 1 is made by passing make-up zinc oxide through lines 5 and 6, through reaction zone 40 and ultimately line 3.

Ash accumulates in the lower section of the reactor 1 and is withdrawn via line 7. Carbon monoxide and zinc, as well as any other gaseous byproducts, are removed free of entrained solids from reactor 1 via line 8. A cyclone, not shown, can be provided in reactor 1 to effect separation of entrained solids from the reactor gaseous effluent and return thereof to the reactor bed.

Effluent gas consisting essentially of carbon monoxide and zinc is passed via line 8 to heat exchanger 9 wherein gas is condensed through indirect heat exchange with liquid zinc from phase separator 10. In phase separator 10 the liquid zinc is separated from the CO gas. Product gas is removed via line 11.

The condensed liquid zinc in the lower portion of phase separator 10 is withdrawn via line 12, passed through heat exchanger 9 to revaporize the zinc by indirect heat exchange with the reactor product gases, and introduced into line 13. In line 13, the zinc vapor is admixed with hot air (900 ° to 1650 ° C.) via conduit 14. The resulting admixture is then passed to reaction zone 40 via line 6 wherein the zinc is oxidized to zinc oxide. Following oxidation, the reaction mass is passed via line 41 to separator 42 wherein the gaseous content, consisting essentially of nitrogen and excess oxygen, is removed via line 43. Zinc oxide is withdrawn from the bottom of separator 42 via line 3 and introduced to reactor 1.

The gaseous product stream consisting essentially of carbon monoxide and some carbon dioxide recovered via line 11 from separator 10 can be treated in heat recovery unit 16 to remove heat therefrom for further use. Thereafter the gaseous stream is passed to a carbon dioxide absorber-stripper 18 via line 17 wherein any $CO_2$ present is removed, thereby providing a product stream 19 which is essentially pure carbon monoxide. $CO_2$ removed in absorber-stripper 18 can be returned via lines 20 and 4 to the main reactor 1 for further use in the fluidizing of the reactor bed or can be vented.

Ash containing entrained zinc values, generally in the form of zinc sulfide, is removed via line 7 from reactor 1 and passed via line 21 into heat exchange relationship with the interior of secondary reactor 23. Hot air (900 ° to 1650 ° C.) is introduced via line 22 into line 21 in an amount to effect conversion of the zinc values in line 21 to the oxide form. Heat generated during this exothermic reaction is provided via heat exchange section 24 to assist in maintaining the contents of secondary reactor 23 at the desired level. Following heat exchange of the reactants moving in heat exchange zone 24, the reactants, principally zinc oxide, ash and nitrogen along with some air and $CO_2$, are passed via line 25 to separator 26 wherefrom gaseous portions consisting essentially of nitrogen, air and carbon dioxide are removed via line 27 and solid particles consisting essentially of a mixture of zinc oxide and ash and further oxidized char are removed via line 28 and introduced into secondary reactor 23. A second char charge having a low sulfur content is introduced via line 29 into secondary reactor 23, which is operated in a manner similar to that of primary reactor 1 but generally at higher temperature and longer reaction time. Ash now essentially free of zinc values accumulates in the lower section of reactor 23 and is withdrawn via line 30. Gaseous zinc and CO are withdrawn free of entrained solids overhead via line 31 and are combined in conduit 8 with the gaseous effluent from primary reactor 1.

Gaseous effluent removed from separator 26 via line 27 is passed to heat recovery unit 32. The resulting cooled gas is thereafter passed via line 33 to $CO_2$ absorber-stripper 34 wherein a stream consisting essentially of $CO_2$ is separated and removed via line 35 for recycle via lines 36 and 38 to reactors 1 and 23 or is vented. A further gaseous stream 37 which consists essentially of nitrogen and air is withdrawn from absorber-stripper unit 34.

In the event $SO_2$ is present in the system, a sulfur removal unit 39 can be employed in line 35 whereby an essentailly pure $CO_2$ stream is provided in line 36 with sulfur oxides or sulfur and oxygen being removed from unit 39 via line 40.

By carrying out the process of this invention in the manner as above described, there is achieved the recovery of otherwise lost zinc values along with the ability to use such recovered values for the conversion of a further portion of the carbon source to the desired carbon monoxide product, thereby increasing the overall efficiency of the process. In addition, zinc values are ultimately recovered in a form readily recycled to the primary reactor.

The following calculated example will further illustrate the invention.

EXAMPLE

Char from a COED coal gasofication plant containing about 19 percent ash and 3.2 percent by weight sulfur is fed to a continuous gasification reactor in which zinc oxide is used as the oxygen donor. The char is preheated to near reactor temperature of 2000 ° F. (1093 ° C.) and fed at a rate of 1021 kg/hr. to the reactor operating at 16 psia (110 kPa). Zinc oxide obtained by oxidation of zinc vapor with air is introduced into the reactor at a rate of 4441 kg/hr. Average retention time of solids in the reactor is 10 minutes. Ash concentrate containing 52 weight percent zinc values is removed at the rate of 428 kg/hr. from the reactor and oxidized with hot air (900 ° to 1650 ° C.) in an oxidation coil which is immersed in the fluid bed of a secondary reactor, whereby the zinc values removed with ash from the first reactor are converted to zinc oxide. Effluent from the oxidation coil is phase-separated, the resulting oxidized zinc values being fed to the secondary reactor along with 103 kg/hr. of a low-sulfur char derived from McDowell County, West Virginia coal containing 1 weight percent sulfur for gasification at reactor conditions of 2200 ° F. (1206 ° C.), 16 psia (110 kPa) and an average solids retention time of 30 minutes. The reactor bed is mixed with 30 kg/hr. of $CO_2$. Ash containing 2.2 weight percent zinc values is removed at 228 kg/hr.

from the secondary reactor. Product gases from both gasification zones are combined, cooled and the zinc condensed therefrom, the zinc being subsequently revaporized and oxidized with air in a coil submerged in the fluidized bed to supply the heat of reaction for the primary char gasification. Coil effluent passes to a separation zone for recovery of the zinc oxide, which is fed to the primary gasifier. Product gases from both reaction zones may be processed for recovery of $CO_2$, which can be used for gasifier fluidization. Total product yield is 1917 kg/hr. of CO plus minor amounts of impurities.

Reasonable variation and modifications, which will become apparent to those skilled in the art, can be made in this invention without departing from the spirit and scope thereof.

What is claimed is:

1. A process for the production of carbon monoxide which comprises a. reacting a first quantity of a solid carbon source in a first reaction zone with zinc oxide at a temperature of 910 ° to 1540 ° C. to produce a first volume of gas consisting essentially of zinc and carbon monoxide and a solids byproduct consisting essentially of ash having zinc values entrained therein, b. separating zinc from said first volume of gas and recovering a carbon monoxide-containing gas as a product of the process, c. passing said solids byproduct from said first reaction zone to an oxidation zone wherein said zinc values in said solids byproduct are oxidized to zinc oxide, thereby forming a solid mixture consisting essentially of ash and zinc oxide, d. reacting said solid mixture in a second reaction zone at a temperature of 910 ° to 1540 ° C. with a second quantity of a carbon source to produce a second volume of gas consisting essentially of zinc and carbon monoxide and withdrawing solids containing ash which is essentially free of zinc from the second reaction zone, and thereafter e. separating zinc from said second volume of gas and recovering a carbon monoxide-containing gas as a product of the process, and oxidizing the separated zinc to form zinc oxide which thereafter is recycled to said first reaction zone.

2. A process in accordance with claim 1 wherein said solid carbon source and said zinc oxide are admixed in finely divided form in said first reaction zone to form a reaction mixture.

3. A process in accordance with claim 1 wherein said gas from said first and second reaction zones is separated into a gas stream consisting essentially of carbon monoxide and a zinc stream by condensing said zinc.

4. A process in accordance with claim 1 wherein about 0.8 to about 1.2 moles of zinc oxide are used per gram atom of carbon in the carbon source in each reaction zone.

5. A process in accordance with claim 1 wherein a fluidizing gas is injected into said first and second reaction zones.

6. A process in accordance with claim 5 wherein said fluidizing gas is carbon dioxide, carbon monoxide or a mixture thereof.

7. A process according to claim 1 wherein said second quantity of carbon source has a sulfur content below that of said first quantity of solid carbon source.

8. A process according to claim 1 wherein said solid carbon source in said first reaction zone contains 0.01 to 8.0 weight percent of sulfur and wherein said carbon source in said second reaction zone is essentially sulfur-free.

9. A process according to claim 1 wherein said solid source for said first reaction zone is a particulate carbonaceous residue of a coal gasification or liquefaction process.

10. A process according to claim 9 wherein said carbon source for said second reaction zone is a solid, particulate carbonaceous residue of a coal gasification or liquefaction process using a low sulfur content coal.

11. A process according to claim 1 wherein from said second volume of gas consisting essentially of zinc and carbon monoxie from said second reactor is combined with said fist volume of gas from said first reactor and thereafter said zinc is separated from the resulting combined gas stream.

12. A process according to claim 1 wherein a reaction mixture of air and ash containing zinc values is heated to a temperature in the range of 1093 ° to 1650 ° C. in said oxidation zone.

13. A process according to claim 7 wherein said second carbon source is an essentially sulfur-free coal char.

14. A process according to claim 1 wherein said first solid source is a coal char containing from 0.01 to 8.0 weight percent sulfur and said second carbon source is a low sulfur content char having a sulfur content less than that of said first carbon source.

* * * * *